US010102797B2

(12) United States Patent
Park et al.

(10) Patent No.: US 10,102,797 B2
(45) Date of Patent: Oct. 16, 2018

(54) IMAGE STICKING CONTROLLER AND METHOD FOR OPERATING THE SAME

(71) Applicant: SAMSUNG DISPLAY CO., LTD., Yongin, Gyeonggi-Do (KR)

(72) Inventors: Jong-Woong Park, Yongin (KR); Won-Woo Jang, Yongin (KR); Yong-Seok Choi, Yongin (KR); Joo-Hyung Lee, Yongin (KR)

(73) Assignee: SAMSUNG DISPLAY CO., LTD., Yongin, Gyunggi-Do (KR)

( * ) Notice: Subject to any disclaimer, the term of this patent is extended or adjusted under 35 U.S.C. 154(b) by 167 days.

(21) Appl. No.: 14/501,402

(22) Filed: Sep. 30, 2014

(65) Prior Publication Data

US 2015/0097876 A1 Apr. 9, 2015

(30) Foreign Application Priority Data

Oct. 4, 2013 (KR) ..... 10-2013-0118418

(51) Int. Cl.
*G09G 5/10* (2006.01)
*G09G 3/3225* (2016.01)

(52) U.S. Cl.
CPC ... *G09G 3/3225* (2013.01); *G09G 2320/0233* (2013.01); *G09G 2320/0276* (2013.01);
(Continued)

(58) Field of Classification Search
CPC ..... G09G 2320/02; G09G 2320/0233; G09G 2320/0257; G09G 2320/0271;
(Continued)

(56) References Cited

U.S. PATENT DOCUMENTS 8,686,925 B2 * 4/2014 Chung ..... G09G 3/3291 345/76
2005/0179628 A1 * 8/2005 Kimura ..... G09G 3/3233 345/77

(Continued)

FOREIGN PATENT DOCUMENTS

KR 10-2008-0034690 A 4/2008
KR 10-2009-0073262 A 7/2009

(Continued)

*Primary Examiner* — Roberto Flores
(74) *Attorney, Agent, or Firm* — Lee & Morse P.C.

(57) ABSTRACT

An image sticking controller includes a gamma conversion unit configured to gamma-convert gray scale values respectively corresponding to a plurality of pixels, and to output the gamma-converted gray scale values as gamma conversion values, a data accumulation unit configured to accumulate the gamma conversion values into an accumulation data, the accumulation data including a minimum accumulation value, a maximum difference value indicating a difference between the minimum accumulation value and a maximum accumulation value, and difference values indicating respective differences between the minimum accumulation value and an accumulation value of each of the pixels, an image sticking analysis unit configured to output an image sticking decrease control signal when the maximum difference value is greater than a reference value, and a data conversion unit configured to convert the gray scale values in response to the image sticking decrease control signal, such that image sticking is reduced.

13 Claims, 2 Drawing Sheets

(52) U.S. Cl.
CPC . *G09G 2320/046* (2013.01); *G09G 2320/048* (2013.01); *G09G 2360/16* (2013.01)

(58) Field of Classification Search
CPC ..... G09G 2320/0276; G09G 2320/0285–2320/0295; G09G 2320/04; G09G 2320/043–2320/048; G09G 2320/0673; G09G 2320/0693; G09G 5/10; G09G 3/006; G09G 3/3208; H04N 17/00; H04N 17/004; H04N 17/02; G02F 1/1309
USPC ..... 345/76–77, 690–699
See application file for complete search history.

(56) References Cited

U.S. PATENT DOCUMENTS

2006/0077136 A1* 4/2006 Cok ..... G09G 3/3216 345/76
2007/0236431 A1* 10/2007 Tada ..... G09G 3/3208 345/84
2008/0001974 A1* 1/2008 Kim ..... G09G 3/3233 345/690
2008/0089604 A1 4/2008 Kim et al.
2008/0150839 A1* 6/2008 Kawabe ..... G09G 3/3225 345/63
2009/0147032 A1* 6/2009 Kim ..... G09G 3/3225 345/690
2010/0165009 A1 7/2010 Mori et al.
2012/0256971 A1* 10/2012 Shin ..... G09G 3/3233 345/690
2013/0002960 A1 1/2013 Ryu et al.
2013/0176324 A1* 7/2013 Yamashita ..... G09G 5/02 345/589
2014/0168039 A1* 6/2014 Kim ..... G09G 3/3208 345/82
2016/0086548 A1* 3/2016 Maeyama ..... G09G 3/3258 345/690

FOREIGN PATENT DOCUMENTS

KR 10-2010-0019484 A 2/2010
KR 10-2013-0002118 A 1/2013

* cited by examiner

IMAGE STICKING CONTROLLER AND METHOD FOR OPERATING THE SAME

CROSS-REFERENCE TO RELATED APPLICATION

Korean Patent Application No. 10-2013-0118418, filed on Oct. 4, 2013, in the Korean Intellectual Property Office, and entitled: "Image Sticking Controller and Method for Operating the Same," is incorporated by reference herein in its entirety.

BACKGROUND

1. Field

An aspect of the present disclosure relates to an organic light emitting display and a method for operating the same.

2. Description of the Related Art

Recently, there have been developed various types of flat panel displays capable of reducing the weight and volume of cathode ray tubes. Such flat panel displays include, e.g., a liquid crystal display, a field emission display, a plasma display panel, an organic light emitting display, and the like.

Among these flat panel displays, the organic light emitting display displays images using organic light emitting diodes (OLEDs) that emit light through recombination of electrons and holes. The organic light emitting display has a fast response speed and is driven with low power consumption. In a general organic light emitting display, a driving transistor included in each pixel supplies current with amplitude corresponding to a data signal, so that light is generated in an organic light emitting diode.

SUMMARY

Embodiments provide an image sticking controller and a method for operating the same, which can reduce image sticking.

According to an aspect of the present disclosure, there is provided an image sticking controller, including a gamma conversion unit configured to gamma-convert gray scale values respectively corresponding to a plurality of pixels, and to output the gamma-converted gray scale values as gamma conversion values, a data accumulation unit configured to accumulate the gamma conversion values into an accumulation data, the accumulation data including a minimum accumulation value, a maximum difference value indicating a difference between the minimum accumulation value and a maximum accumulation value, and difference values indicating respective differences between the minimum accumulation value and an accumulation value of each of the pixels, an image sticking analysis unit configured to output an image sticking decrease control signal when the maximum difference value is greater than a reference value, and a data conversion unit configured to convert the gray scale values in response to the image sticking decrease control signal, such that image sticking is reduced.

Each difference value may have a value between 0 and 1, in proportion to a difference between the minimum accumulation value and the accumulation value of each pixel.

The data accumulation unit may, for consecutive frames, multiply the difference values and the maximum difference value, add the accumulation values generated by adding the minimum accumulation value and the gamma conversion values corresponding to a current frame, and then recalculate the minimum accumulation value, the maximum difference value and the difference values.

The bit-sizes of the gray scale values may be respectively equal to those of the difference value.

The data conversion unit may decrease the gray scale values, in response to the image sticking decrease control signal, and output the decreased gray scales.

The data conversion unit may gradually increase a decrement of the gray scale values during a period in which the image sticking decrease control signal is continuously supplied.

The data conversion unit may decrease the gray scale value of first pixels among the plurality of pixels, which have a corresponding accumulation value greater than the reference value, in response to the image sticking decrease control signal.

The data conversion unit may increase the gray scale value of second pixels except the first pixels among the plurality of pixels, in response to the image sticking decrease control signal.

When a data including the gray scale values is not supplied from an outside of the image sticking controller, the data conversion unit may reverse the accumulation values and output the reversed accumulation values for a predetermined time.

According to an aspect of the present disclosure, there is provided a method for operating an image sticking controller, the method including receiving a first data supplied from an outside of the image sticking controller, gamma-converting gray scale values included in the first data accumulating the gamma-converted values, thereby generating an accumulation data including a minimum accumulation value, a maximum difference value which indicates a difference between the minimum accumulation value and a maximum accumulation value, and difference values which respectively indicate differences between the minimum accumulation value and the accumulation values of the pixels; comparing the maximum difference value with a reference value, and generating a second data by converting the gray scale values so that image sticking is reduced when the maximum difference value is greater than the reference value.

The generating of the accumulation data may include extracting the minimum accumulation value and the maximum accumulation value from the accumulation values; generating the maximum difference value by subtracting the minimum accumulation value from the maximum accumulation value; and generating the difference values by subtracting the maximum accumulation value from each accumulation value and recalculating the maximum difference value.

The generating of the second data may include generating the second data by gradually decreasing each gray scale value.

The generating of the second data may include generating the reverse data of the accumulation data as the second data when the first data is not supplied.

BRIEF DESCRIPTION OF THE DRAWINGS

Features will become apparent to those of skill in the art by describing in detail exemplary embodiments with reference to the attached drawings, in which.

DETAILED DESCRIPTION

Figure 1:
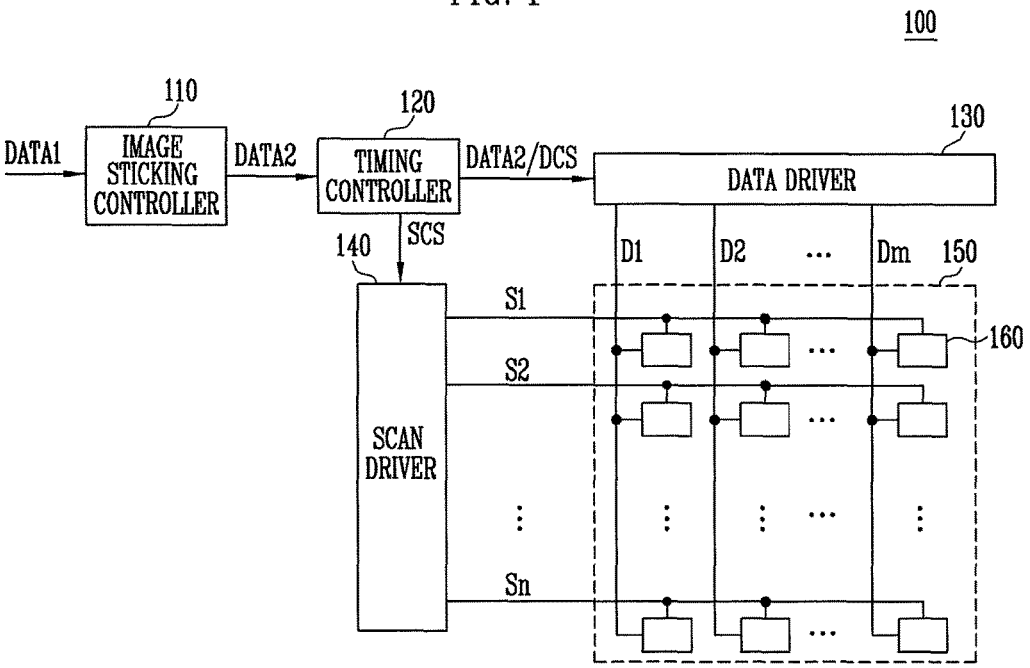
FIG. 1 illustrates a block diagram of an organic light emitting display according to an embodiment.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

In the drawing figures, dimensions may be exaggerated for clarity of illustration. It will be understood that when an element is referred to as being "between" two elements, it can be the only element between the two elements, or one or more intervening elements may also be present. Similarly, when a first element is described as being coupled to a second element, the first element may be not only directly be coupled to the second element but may also be indirectly coupled to the second element via a third element. Further, some of the elements that are not essential to the complete understanding of the disclosure are omitted for clarity. Also, like reference numerals refer to like elements throughout.

FIG. 1 illustrates a block diagram of an organic light emitting display according to an embodiment.

Referring to FIG. 1, an organic light emitting display 100 according to this embodiment may include an image sticking controller 110, a timing controller 120, a data driver 130, a scan driver 140, and a display unit 150.

The image sticking controller 110 accumulates a first data DATA1 supplied from an outside thereof for consecutive frames, thereby generating an accumulation data ADATA. The image sticking controller 110 generates a second data DATA2 by converting the first data DATA1, based on the accumulation data ADATA, so that a residual image, i.e., image sticking, is prevented or substantially reduced. Then, the image sticking controller 110 supplies the generated second data DATA2 to the timing controller 120.

The structure and operation of the image sticking controller 110 will be described in detail with reference to FIG. 2.

The timing controller 120 controls operations of the data driver 130 and the scan driver 140, in response to a synchronization signal (not shown) supplied from an outside thereof. In detail, the timing controller 120 generates a data driving control signal DCS and supplies the generated data driving control signal DCS to the data driver 130. The timing controller 120 generates a scan driving control signal SCS and supplies the generated scan driving control signal SCS to the scan driver 140. The timing controller 120 also supplies to the data driver 130 the second data DATA2 supplied from the image sticking controller 110.

Although the image sticking controller 110 and the timing controller 120 are illustrated separately in FIG. 1, embodiments are not limited thereto. For example, the image sticking controller 110 and the timing controller 120 may be implemented with one circuit.

The data driver 130 realigns the second data DATA2 supplied from the timing controller 120, in response to the data driving control signal DCS output from the timing controller 120, and supplies the realigned second data DATA2 as data signals to data lines D1 to Dm.

The scan driver 140 progressively supplies a scan signal to scan lines S1 to Sn, in response to the scan driving control signal SCS output from the timing controller 120.

The display unit 150 includes pixels 160 respectively disposed at intersection portions of the data lines D1 to Dm and the scan lines S1 to Sn. For example, the data lines D1 to Dm may be arranged along vertical lines, and the scan lines S1 to Sn may be arranged along horizontal lines.

Each pixel 160 emits light with luminance corresponding to a data signal supplied through a corresponding data line among the data lines D1 to Dm, when a scan signal is supplied through a corresponding scan line among the scan lines S1 to Sn. Each pixel 160 emits light of any one color of red, green, and blue.

Figure 2:
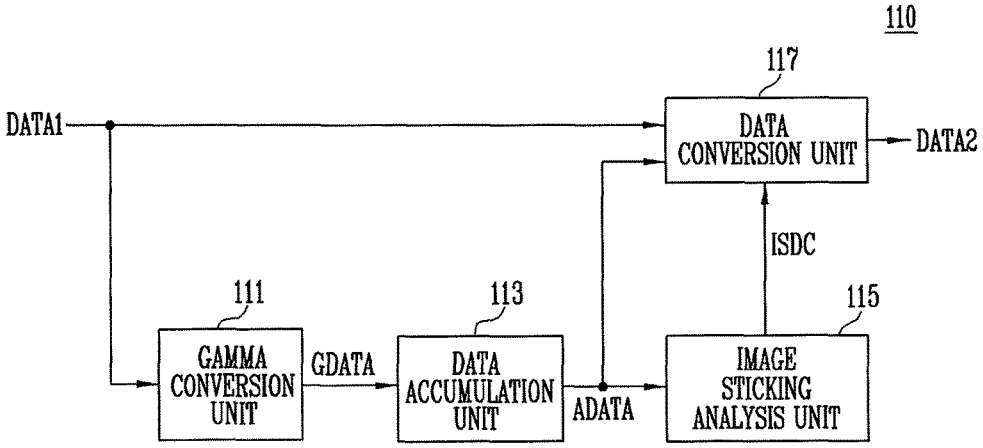
FIG. 2 illustrates a detailed block diagram of an image sticking controller in FIG. 1.

FIG. 2 illustrates a detailed block diagram of the image sticking controller 110. Referring to FIG. 2, the image sticking controller 110 may include a gamma conversion unit 111, a data accumulation unit 113, an image sticking analysis unit 115, and a data conversion unit 117.

The gamma conversion unit 111 generates a gamma conversion data GDATA by gamma-converting the first data DATA1 supplied from the outside of the image sticking controller 110. That is, the gamma conversion unit 111 gamma-converts gray scale values corresponding to the respective pixels 160 included in the first data DATA1, and outputs the gamma-converted gray scale values, i.e., the gamma conversion data GDATA including gamma conversion values. In detail, the gamma conversion unit 111 exponentiates a predetermined gamma constant to each gray scale value of a pixel, e.g., raises the predetermined gamma constant to the power of each gray scale value, to generate the gamma conversion data GDATA. Then, the gamma conversion unit 111 outputs the gamma conversion data GDATA to the data accumulation unit 113.

The data accumulation unit 113 generates the accumulation data ADATA by accumulating the gamma conversion data GDATA output from the gamma conversion unit 111 for consecutive frames. That is, the data accumulation unit 113 accumulates gamma conversion values included in the gamma conversion data GDATA, and generates the accumulation data ADATA including the accumulated gamma conversion values, i.e., information on accumulation values. The data accumulation unit 113 converts and stores the accumulation values in order to limit the size of a memory for storing the accumulation data ADATA.

In detail, the accumulation data ADATA includes a minimum accumulation value, a maximum difference value which indicates a difference between the minimum accumulation value and a maximum accumulation value, and difference values which respectively indicate differences between the minimum accumulation value and the accumulation values of each of the pixels 160. That is, generating the accumulation data ADATA includes extracting a single minimum accumulation value and a single maximum accumulation value from the accumulation values of all the pixels 160, generating the maximum difference value by subtracting the extracted minimum accumulation value from the extracted maximum accumulation value, and generating the difference values by subtracting the extracted maximum accumulation value from each accumulation value of each of the pixels 160. Therefore, the accumulation data ADATA includes a single minimum accumulation value, a single maximum difference value, and a plurality of difference values corresponding to the plurality of pixels 160, i.e., a difference value for each pixel 160.

Each difference value of the plurality of difference values has a value between 0 and 1, in proportion to a difference between the minimum accumulation value and the accumulation value of each pixel 160. For example, when the accumulation value of any one pixel among the pixels 160 is equal to the minimum accumulation value, the difference value corresponding to the one pixel becomes 0. On the contrary, when the accumulation value of the one pixel is equal to the maximum accumulation value, the difference value corresponding to the one pixel becomes 1.

The data accumulation unit 113 sets the bit-sizes of the difference value to be equal to those of the respective gray scale values, thereby preventing an increase in the entire size of the accumulation data ADATA.

The data accumulation unit 113 generates accumulation values of consecutive frames up to a previous frame by multiplying the difference values included in the accumulation data ADATA and the maximum difference values, and adding the minimum accumulation values. The data accumulation unit 113 updates the accumulation data ADATA by recalculating the minimum accumulation value, the maximum difference value, and the difference values up to a current frame, based on the value obtained by adding the accumulation values up to the previous frame to gray scale values corresponding to the current frame.

The data accumulation unit 113 outputs the accumulation data ADATA including information up to the current frame to the image sticking analysis unit 115 and the data conversion unit 117.

The image sticking analysis unit 115 predicts an image sticking occurrence possibility, based on the accumulation data ADATA, and outputs an image sticking decrease control signal (ISDC) to the data conversion unit 117, based on the predicted result. In detail, the image sticking analysis unit 115 predicts an image sticking occurrence possibility, based on the maximum difference value included in the accumulation data ADATA. That is, the image sticking analysis unit 115 compares the maximum difference value with a reference value. When the maximum difference value is greater than the reference value, the image sticking analysis unit 115 outputs, to the data conversion unit 117, the image sticking decrease control signal ISDC which allows an image sticking decrease process to be performed.

The data conversion unit 117 generates the second data DATA2 by converting the first data DATA1 supplied from the outside, in response to the image sticking decrease control signal ISDC output from the image sticking analysis unit 115. That is, the data conversion unit 117 converts gray scale values of the first data DATA1 into the second data DATA2 when the analysis unit 115 outputs the ISDC, e.g., only when the maximum difference value is greater than the reference value, so that the image sticking can be decreased in response to the image sticking decrease control signal ISDC.

According to an embodiment, the data conversion unit 117 may generate the second data DATA2 by entirely decreasing the gray scale values of the first data DATA1, in response to the image sticking decrease control signal ISDC. When the image sticking decrease control signal ISDC is continuously supplied during several frames, the data conversion unit 117 may gradually increase a decrement of gray scale values corresponding to first pixels. The data conversion unit 117 may limit the decrement of the gray scale values so that an image is not darkened so much.

According to another embodiment, the data conversion unit 117 may generate the second data DATA2 by selectively decreasing or increasing some of the gray scale values of the first data DATA1, in response to the image sticking decrease control signal ISDC. In detail, the data conversion unit 117 may decrease gray scale values corresponding to the first pixels among the pixels 160, based on the accumulation data ADATA output from the data accumulation unit 113. Here, the first pixels mean pixels among the pixels 160, of which corresponding accumulation value is greater than the reference value. That is, the data conversion unit 117 predicts the first pixels of which corresponding accumulation value is greater than the reference value as pixels having a high image sticking occurrence possibility, and decreases gray scale values supplied to the first pixels, thereby delaying degradation of the first pixels.

Additionally, the data conversion unit 117 may increase gray scale values corresponding to second pixels except the first pixels. That is, the data conversion unit 117 increases gray scale values supplied to the second pixels of which corresponding accumulation value is smaller than the reference value, thereby accelerating degradation of the second pixels. That is, the data conversion unit 117 delays the degradation of the first pixels and accelerates the degradation of the second pixels, thereby reducing the image sticking.

According to still another embodiment, when the first data DATA1 is not supplied from the outside, the data conversion unit 117 may reverse accumulation values and output the reversed accumulation values as the second data DATA2. In other words, the data conversion unit 117 may generate the second data DATA2 capable of compensating for degradation of the pixels, based on the accumulation data ADATA, during a period in which the organic light emitting display 100 is turned off. In detail, the data conversion unit 117 may calculate accumulation values of the respective pixels 160, based on the minimum accumulation value, the maximum difference value and the difference values included in the accumulation value ADATA, and generate the reverse value of the calculated accumulation values as the second data DATA2. The organic light emitting display 100 displays the second data DATA2 through the display unit 150 during predetermined frames, thereby reducing the degradation variation between the pixels 160.

Figure 3:
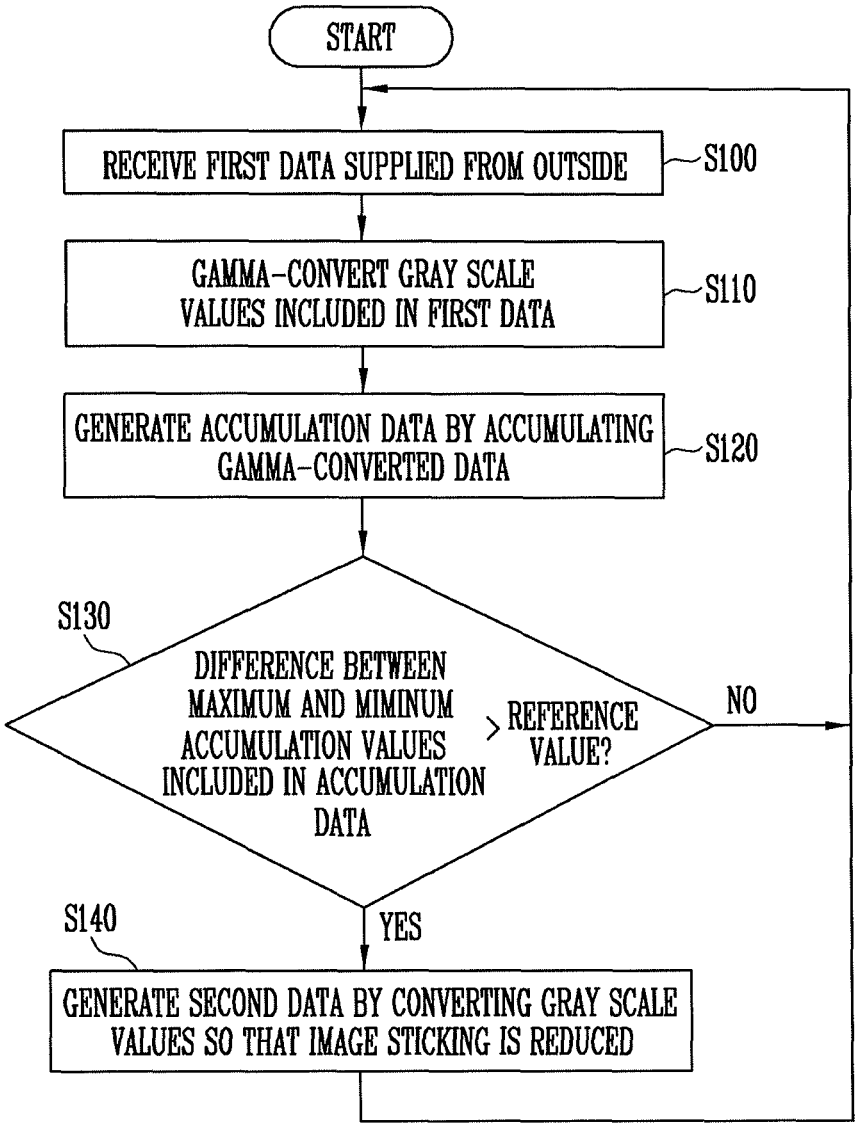
FIG. 3 illustrates a flowchart of a method for operating the image sticking controller shown in FIG. 1.

FIG. 3 illustrates a flowchart of a method for operating the image sticking controller 110.

Referring to FIG. 3, the image sticking controller 110 generates the accumulation data ADATA by accumulating the first data DATA1 supplied from an outside thereof. That is, the image sticking controller 110 receives the first data DATA1 (S100), and generates the gamma conversion data GDATA by gamma-converting gray scale values included in the received first data DATA1 (S110). The image sticking controller 110 generates the accumulation data ADATA by accumulating the generated gamma conversion data GDATA (S120).

The image sticking controller 110 compares the maximum difference value which indicates a difference between minimum and maximum accumulation values included in the accumulation data ADATA with a reference value (S130). When the maximum difference value is greater than the reference value, the image sticking controller 110 generates the second data DATA2 by converting gray scale values included in the first data DATA1 so that the image sticking is reduced (S140), and the image sticking controller 110 supplies the generated second data DATA2 to the timing controller 120. When the maximum difference value is smaller than the reference value, the image sticking controller 110 does not convert the first data DATA1 but supplies the first data DATA1 to the timing controller 120.

The image sticking controller 110 generates the second data DATA2 so that the degradation variation between the pixels 160 can be compensated, thereby reducing the image sticking of the display unit 150.

According to an embodiment, the image sticking controller 110 may entirely decrease gray scale values corresponding to the respective pixels 160 so that the image sticking is not easily visible, e.g., noticed by a user. When the maximum difference value is continuously smaller than the reference value for consecutive frames, the image sticking controller 110 may gradually increase the decrement of the gray scale values.

According to another embodiment, the image sticking controller 110 may decrease gray scale values corresponding to pixels of which degradation is relatively more advanced among the pixel 160, and may increase gray scale values corresponding to pixels of which degradation is relatively less advanced among the pixels 160, thereby reducing the degradation variation between the pixels 160.

According to still another embodiment, the image sticking controller 110 may supply the reverse data of the accumulation data GDATA during the period in which the organic light emitting display 100 is turned off, thereby reducing the degradation variation between the pixels 160.

By way of summation and review, a conventional organic light emitting display may not display an image with a desired luminance due to a change in efficiency, e.g., caused by degradation of organic light emitting diodes. For example, image sticking, e.g., image retention on a screen, may occur due to some degraded organic light emitting diodes.

In contrast, the image sticking controller and the method for operating the same, according to embodiments, may reduce the image sticking while controlling an increase in the use amount of memory.

Example embodiments have been disclosed herein, and although specific terms are employed, they are used and are to be interpreted in a generic and descriptive sense only and not for purpose of limitation. Accordingly, it will be understood by those of skill in the art that various changes in form and details may be made without departing from the spirit and scope of the present invention as set forth in the following claims.

What is claimed is:

1. An image sticking controller, comprising:

a gamma converter configured to gamma-convert gray scale values respectively corresponding to a plurality of pixels, and to output the gamma-converted gray scale values as gamma conversion values;

a data accumulator configured to generate accumulation pixel data respectively corresponding the plurality of pixels values by accumulating the gamma conversion values, wherein accumulation pixel data are generated by:

extracting a minimum accumulation pixel data among the accumulation pixel data, extracting a maximum accumulation pixel data among the accumulation pixel data, generating a maximum difference value indicating a difference between the minimum accumulation pixel data and the maximum accumulation pixel data, generating difference values indicating respective differences between the minimum accumulation pixel data and accumulation pixel data of each pixel, and corresponding each difference value to a value between 0 and 1 to reduce a size of the accumulation pixel data;

an image sticking analyzer configured to output an image sticking decrease control signal when the maximum difference value is greater than a reference value; and a data converter configured to convert the gray scale values in response to the image sticking decrease control signal, such that image sticking is reduced.

2. The image sticking controller as claimed in claim 1, wherein the data accumulator corresponds each difference value to the value between 0 and 1, in proportion to a difference between the minimum accumulation pixel data and the accumulation pixel data of each pixel.

3. The image sticking controller as claimed in claim 1, wherein, for consecutive frames, the data accumulator is configured to multiply the difference values and the maximum difference value, add the accumulation pixel data generated by adding the minimum accumulation pixel data and the gamma conversion values corresponding to a current frame, and recalculate the minimum accumulation pixel data, the maximum difference value, and the difference values.

4. The image sticking controller as claimed in claim 1, wherein bit-sizes of the gray scale values are respectively equal to those of the difference value.

5. The image sticking controller as claimed in claim 1, wherein the data converter is configured to decrease the gray scale values, in response to the image sticking decrease control signal, and to output the decreased gray scales.

6. The image sticking controller as claimed in claim 5, wherein the data converter is configured to gradually increase a decrement of the gray scale values during a period in which the image sticking decrease control signal is continuously supplied.

7. The image sticking controller as claimed in claim 1, wherein the data converter configured to decrease gray scale value of first pixels among the plurality of pixels, which have a corresponding accumulation pixel data greater than the reference value, in response to the image sticking decrease control signal.

8. The image sticking controller as claimed in claim 7, wherein the data converter configured to increase gray scale value of second pixels, other than the first pixels, among the plurality of pixels, in response to the image sticking decrease control signal.

9. The image sticking controller as claimed in claim 1, wherein when a data including the gray scale values is not supplied from an outside of the image sticking controller, the data converter reverses the accumulation pixel data and outputs the reversed accumulation pixel data for a predetermined time.

10. A method for operating an image sticking controller, the method comprising:

receiving a first data supplied from an outside of the image sticking controller;

gamma-converting gray scale values included in the first data respectively corresponding to a plurality of pixels;

accumulating the gamma-converted values to generate accumulation pixel data respectively corresponding the plurality of pixels, wherein the accumulation pixel data are generated by:

extracting a minimum accumulation pixel data among the accumulation pixel data, extracting a maximum accumulation pixel data among the accumulation pixel data, generating a maximum difference value indicating a difference between the minimum accumulation pixel data and the maximum accumulation pixel data, generating difference values indicating differences between the minimum accumulation pixel data and an accumulation pixel data of each pixel, and corresponding each difference value to a value between 0 and 1, in proportion to a difference between the minimum accumulation pixel data and the accumulation pixel data of each pixel;

comparing the maximum difference value with a reference value; and generating a second data by converting the gray scale values, when the maximum difference value is greater than the reference value, so that image sticking is reduced.

11. The method as claimed in claim 10, wherein generating the accumulation pixel data includes:

extracting the minimum accumulation pixel data and the maximum accumulation pixel data from the accumulation pixel data of the pixels;

generating the maximum difference value by subtracting the minimum accumulation pixel data from the maximum accumulation pixel data; and generating the difference values by subtracting the maximum accumulation pixel data from each accumulation pixel data of each of the pixels and recalculating the maximum difference value.

12. The method as claimed in claim 10, wherein generating the second data includes generating the second data by gradually decreasing each gray scale value.

13. The method as claimed in claim 10, wherein generating the second data includes generating reverse data of the accumulation pixel data as the second data when the first data is not supplied.

* * * * *